US009883784B2

(12) United States Patent
Amoretti

(10) Patent No.: US 9,883,784 B2
(45) Date of Patent: Feb. 6, 2018

(54) STEAM CLEANER FOR CLEANING DOMESTIC AND INDUSTRIAL SURFACES

(71) Applicant: Luigi Amoretti, Mussolente (IT)

(72) Inventor: Luigi Amoretti, Mussolente (IT)

( * ) Notice: Subject to any disclaimer, the term of this patent is extended or adjusted under 35 U.S.C. 154(b) by 0 days.

(21) Appl. No.: 15/108,280

(22) PCT Filed: May 23, 2014

(86) PCT No.: PCT/IB2014/061666

§ 371 (c)(1),
(2) Date: Jun. 24, 2016

(87) PCT Pub. No.: WO2015/177605

PCT Pub. Date: Nov. 26, 2015

(65) Prior Publication Data

US 2017/0095130 A1 Apr. 6, 2017

(51) Int. Cl.
*A47L 11/40* (2006.01)

(52) U.S. Cl.
CPC ..... *A47L 11/4086* (2013.01); *A47L 11/405* (2013.01); *A47L 11/4025* (2013.01); *A47L 11/4044* (2013.01); *A47L 11/4072* (2013.01); *A47L 11/4088* (2013.01)

(58) Field of Classification Search
CPC ..... A47L 11/4086; A47L 11/4025; A47L 11/4044; A47L 11/405; A47L 11/4072; A47L 11/4088
See application file for complete search history.

(56) References Cited

U.S. PATENT DOCUMENTS

| | | | | | |
|---|---|---|---|---|---|
| 4,974,618 | A * | 12/1990 | Nysted | A47L 11/34 | 134/21 |
| 5,237,719 | A * | 8/1993 | Dwyer, Jr. | A47L 11/34 | 15/320 |
| 5,513,415 | A * | 5/1996 | Kent | A47L 11/4061 | 15/320 |
| 2003/0046788 | A1 * | 3/2003 | Kent | A47L 11/34 | 15/320 |
| 2007/0044269 | A1 | 3/2007 | Day | | |
| 2016/0106288 | A1 * | 4/2016 | Hess | A47L 11/4008 | 134/18 |

FOREIGN PATENT DOCUMENTS

| | | |
|---|---|---|
| EP | 0567044 | 10/1993 |
| GB | 2334668 | 9/1999 |
| WO | 0156449 | 8/2001 |

* cited by examiner

*Primary Examiner* — Dung Van Nguyen
(74) *Attorney, Agent, or Firm* — Themis Law

(57) ABSTRACT

An apparatus for cleaning domestic and industrial surfaces includes a box-like machine body having a suction system and a steam generation system housed therein, and defining a front portion and an opposite rear portion; a joint for the end of a first suction and steam carrying flexible duct; the machine body having an additional multifunctional suction and steam delivery unit which is overhangingly supported by the machine body between two bilateral support arms hinged to the machine body, and extending beyond the front portion of the machine body.

10 Claims, 15 Drawing Sheets

STEAM CLEANER FOR CLEANING DOMESTIC AND INDUSTRIAL SURFACES

FIELD OF THE INVENTION

The invention relates to an apparatus for cleaning domestic and industrial surfaces, which is generally designed for cleaning and sanitizing floors and other surfaces of buildings.

BACKGROUND ART

Apparatus for cleaning floors and other surfaces, typically vacuum cleaner appliances are known, which use the suction force generated by a motor, the latter rotatably driving a suction fan located along a suction circuit within the apparatus.

The suction circuit is housed in a container body of the apparatus and has an outwardly facing end, typically the end designed to be the front end, with a connection mouthpiece for a hose, which is designed to be held and handled by a user, whereas the opposite end of the circuit is connected to a storage tank in which the sucked dirt material is collected.

In view of improving the performances of these apparatus, in many cases suction operation is combined with the disruptive force of steam, which is typically generated in a boiler arranged within the body of the apparatus.

A volume of a liquid to be heated and turned into steam, typically water, is loaded into the boiler through a watertight filling opening.

A set of controllable resistors arranged in the boiler heats water until it turns into steam, the latter being later ejected in the form of jets through a conduit that is typically coupled to the suction pipe, for strongly impinging upon the surfaces to be cleaned and sanitized.

Typically, the controls that regulate steam jet ejection and suction are disposed on a handle located on the suction pipe and can be easily actuated by one hand.

These apparatus may have various sizes according to their intended use, and typically smaller apparatus are generally designed for use in home environments, whereas larger apparatus are generally designed for use in industrial environments.

This prior art suffers from certain drawbacks.

A first drawback is that in prior art apparatus the two separate or combined suction and steam delivery actions are only carried out through the distal end of the single hose that connects the debris collection tank with the boiler.

This involves time-consuming cleaning operations for users, especially in case of large surfaces to be cleaned, because the hose must be displaced in every direction to reach all the points of the surfaces to be cleaned.

A second drawback is that these time-consuming operations are also burdensome for users, who are required to both manoeuver the suction hose in every direction and pull the apparatus to reach every point of the surface and clean it thoroughly.

A further drawback is that, in spite of the use of steam, in many cases the dirt deposited in less exposed locations changes its consistency until it becomes an incrustation which firmly adheres to the surfaces, and cannot be removed not only by suction force, but also by the combined and targeted action of steam jets, however powerful they may be.

Another drawback is that prior art apparatus must be typically connected to a power supply point by means of a connection cable for operation, and for this reason users must repeatedly disconnect the cable from one connection point and re-connect it to another point for displacement of the apparatus in every desired direction.

Yet another drawback is that systematic and progressive build-up of calcareous residues in the boiler causes repeated heating and cooling, and reduces the efficiency of both the boiler and the safety devices mounted thereto with the purpose of preventing overpressure and accidental ejection of steam jets (which reach temperatures exceeding 100° C.) when a user is accidentally in front of the steam outlet.

DISCLOSURE OF THE INVENTION

The invention has the object to improve the prior art.

Another object of the invention is to provide an apparatus for cleaning domestic and industrial surfaces that affords quick and effortless cleaning of surfaces of any extent.

Another object of the invention is to provide an apparatus for cleaning domestic and industrial surfaces that allows users to choose how to clean surfaces according to the conditions of the latter.

A further object of the invention is to provide an apparatus for cleaning domestic and industrial surfaces that may also operate for a long time in self-powered mode, i.e. without having to be connected to a power supply point.

A further object of the invention is to provide an apparatus for cleaning domestic and industrial surfaces that is easy to handle and use.

Another object of the invention is to provide an apparatus for cleaning domestic and industrial surface that can carry all the attachments that may be used for cleaning any surfaces aboard.

A further object of the invention is to provide an apparatus for cleaning domestic and industrial surfaces that has a safe operation and allows full removal of any kind of dirt, irrespective of its consistency.

In one aspect the invention relates to an apparatus for cleaning domestic and industrial surfaces as defined in the features of claim 1.

The invention achieves the following advantages:

thorough cleaning of any kind of surface and selection of the mode of operation;

easy and effortless displacement of the apparatus;

provision of a considerably larger cleaning brush as compared with prior art brushes, for use on large surfaces;

high-safety use of the apparatus;

ready availability of all the attachments required for cleaning.

BRIEF DESCRIPTION OF THE DRAWINGS

Further characteristics and advantages of the invention will be more apparent from the detailed description of a preferred, non-exclusive embodiment of an apparatus for cleaning domestic and industrial surfaces, which is shown as non-limiting example in the accompanying drawings, in which.

DETAILED DESCRIPTION OF A PREFERRED EMBODIMENT

Referring to the above mentioned figures, numeral 1 generally designates an apparatus for cleaning domestic and industrial surfaces, hereinafter briefly referred to as apparatus 1.

The machine 1 comprises a box-like machine body 2, which is designed to contain the devices for operation, namely at least one boiler and a suction unit driven by a motor.

Figure 1:
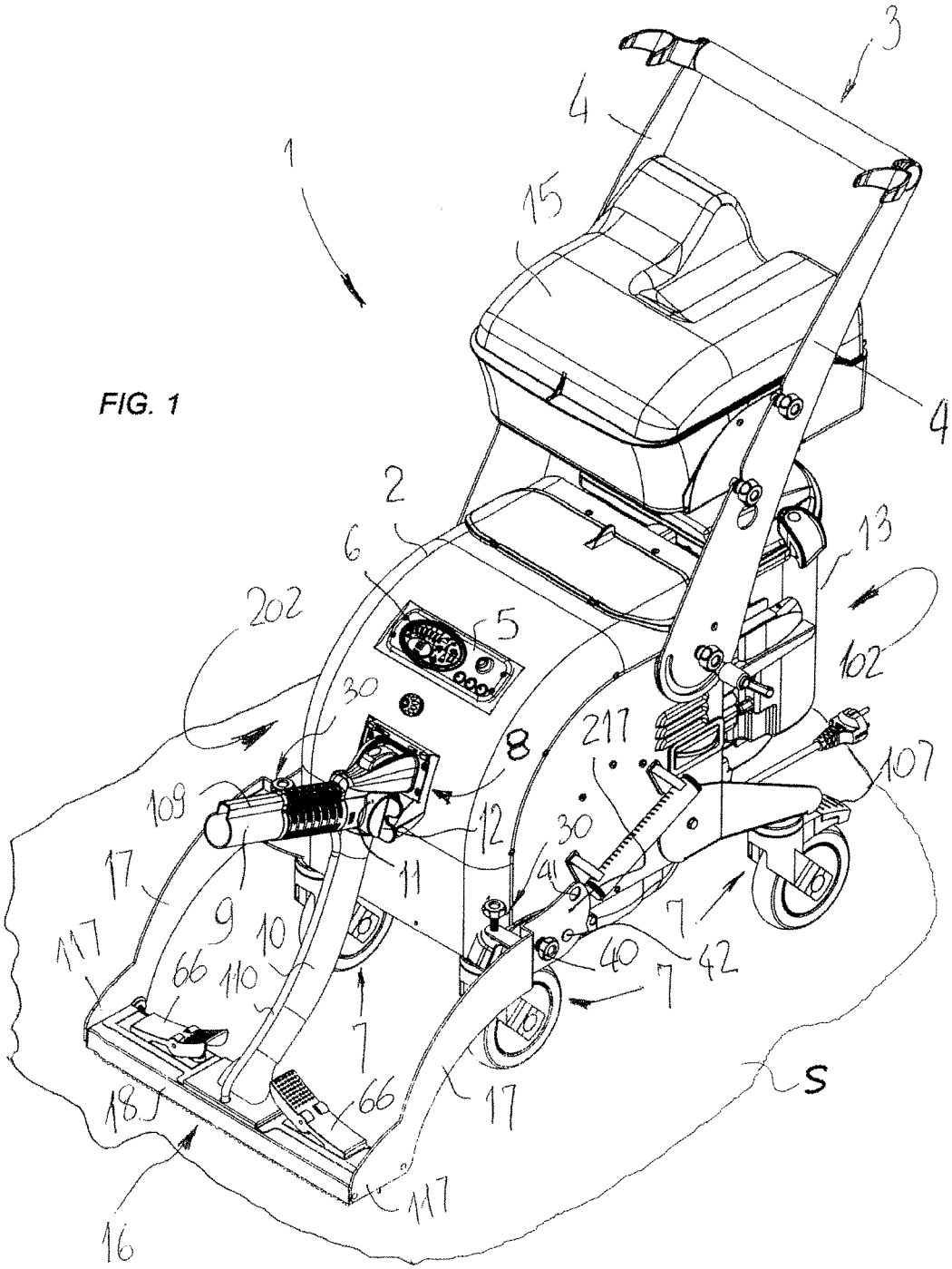
FIG. 1 is a perspective view of the apparatus for cleaning domestic and industrial surfaces according to the invention.

As shown in FIG. 1, the machine body 2 has a handle 3, which is supported by two parallel arms 4 and may be easily held by a user to displace the apparatus 1 over the surface "S" of the ground.

For this reason, the apparatus 1 is equipped with wheels at its bottom, freely rotating about respective vertical axes of rotation and adapted to be braked by special braking devices, referenced 107.

The handle 3 faces a portion of the machine body 2, intended as the rear portion, generally referenced 102, whereas the opposite front portion, generally referenced 202, has a control box 5 thereon, with a display 6 and a joint 8 for the equipment to be maneuvered by users for operation of the apparatus 1.

More in detail, the equipment comprises at least one pipe 9, the figures only showing the end thereof for connection to the joint 8, and a second pipe 10 which, like the first pipe 9, fits into the joint 8 through a common valve body 11 having a flow selector 12, as better explained hereinafter.

Both the first and second pipes 9 and 10 have respective steam conveying and carrying conduits, referenced 109 and 110, which extend from the boiler inside the machine body 2 to the outside, as described below.

The apparatus 1 also has a tank 13 in its rear portion 102, which tank is removable for emptying and collects the sucked up debris and dirt.

Furthermore, a removable box 15 is adapted to be mounted between the arms 4, for containing the attachments that will be used during operation of the apparatus 1.

Figure 10:
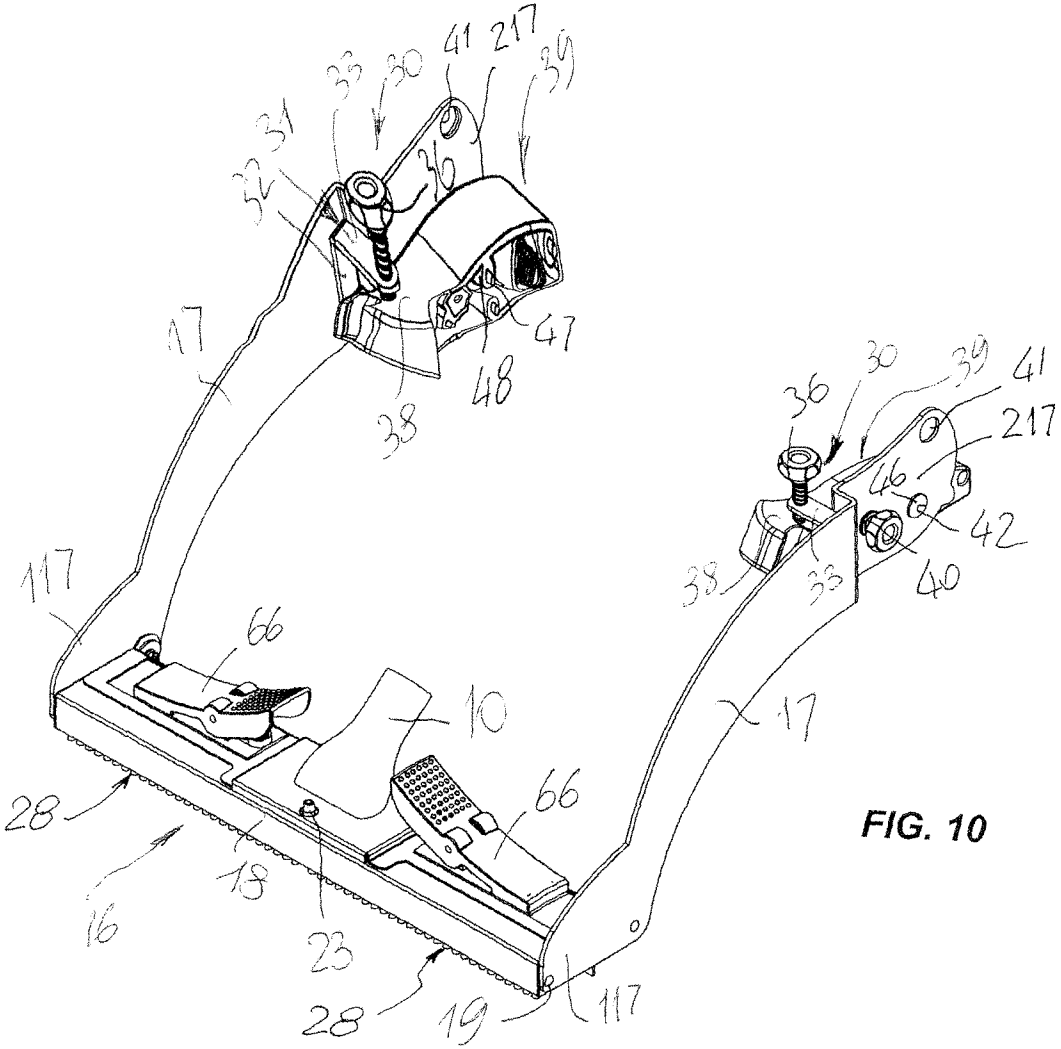
FIG. 10 is a perspective view of a multifunctional element removed from the apparatus of the invention, in a working position, i.e. fully lowered to the ground.
Figure 11:
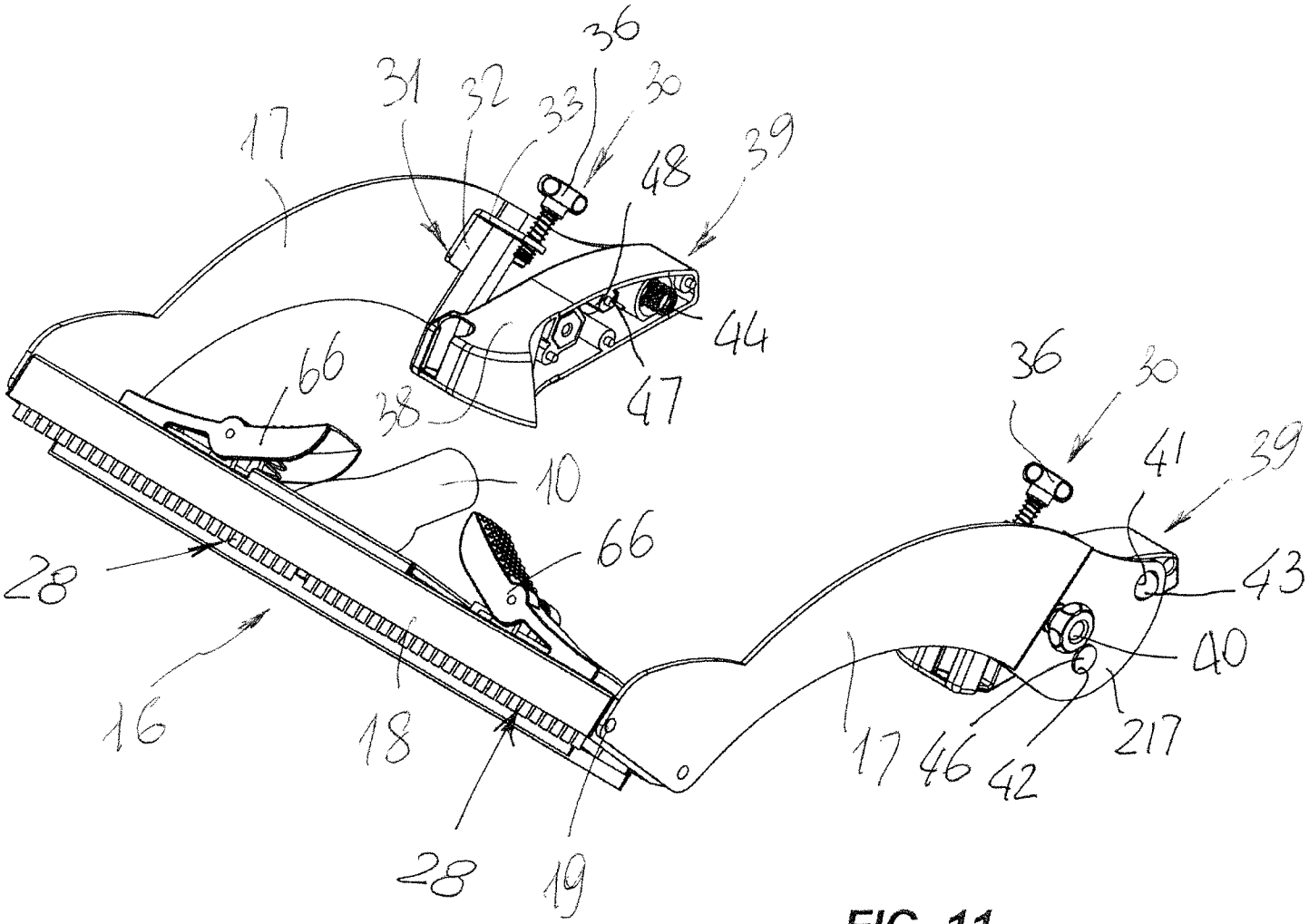
FIG. 11 is a perspective view of the multifunctional element of FIG. 10 in an idle position, i.e. raised from the ground.
Figure 12:
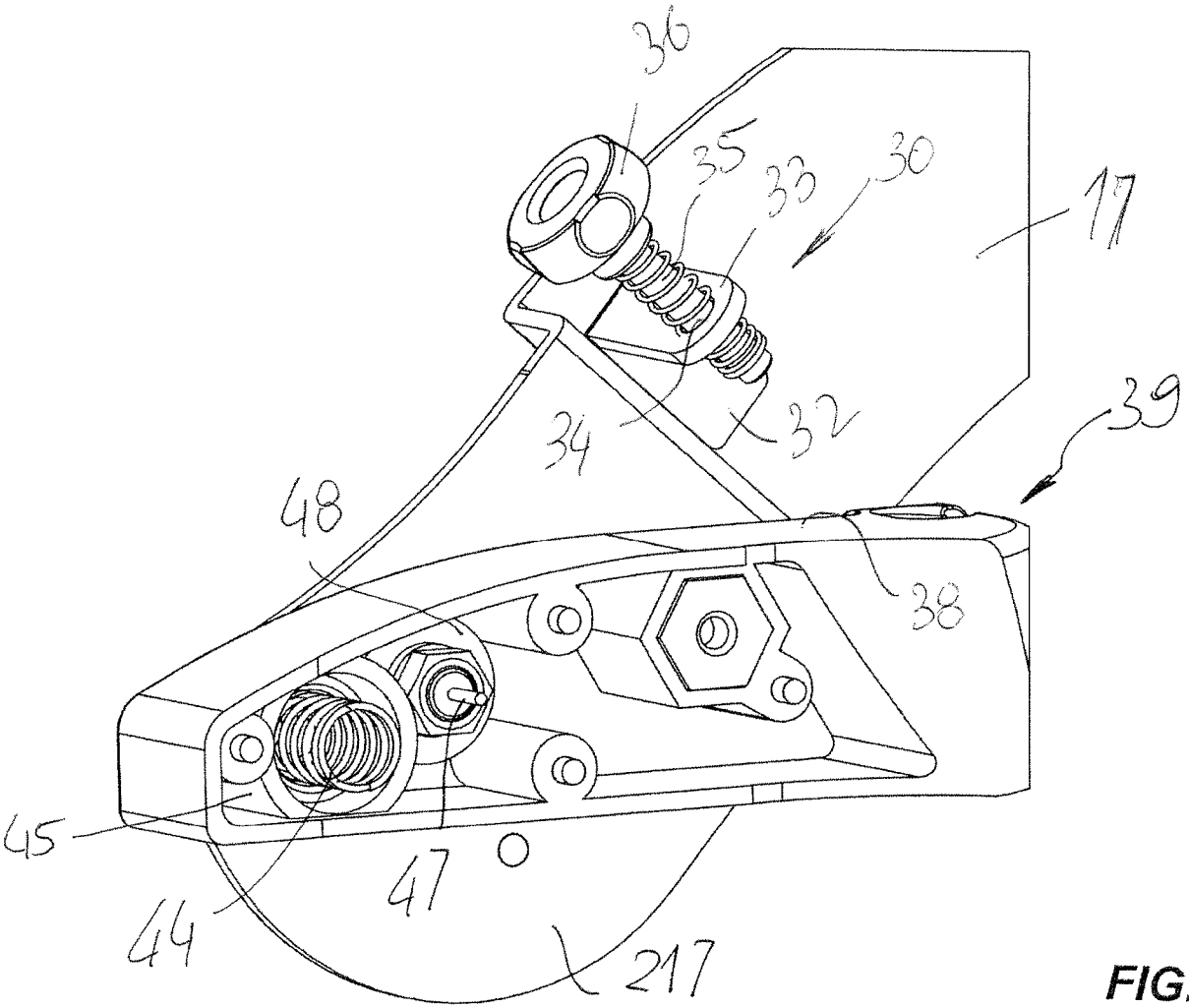
FIG. 12 is an enlarged view of a detail of the area at which the arms that support the multifunctional element attach to the apparatus of the invention.

As shown in the figures, the apparatus 1 has a multifunctional unit 16 in its front portion 202, which unit is supported by the machine body 2 through two bilateral and parallel arms 17, that are hinged thereto to rotate between two end positions, i.e. a working position, i.e. fully lowered to the surface "S" of the ground, as shown in FIGS. 1 and 10, and a raised upwardly rotated idle position, as schematically shown in FIG. 11.

The multifunctional unit 16 is located beyond the front portion 202 in a distal direction relative to the handle 3 and is provided in the form of a brush with a box-like body 18 transversely supported between the distal ends 117 of the arms 17.

The box-like body 18 is supported to pivot about two hinges 19 located in the distal area of the ends 117 and its rotation is controlled by adjustment means 20 disposed at both sides between the box-like body 18 and the distal ends 117, which provide controlled rotation through a circumferential arc of limited extent.

Figure 13:
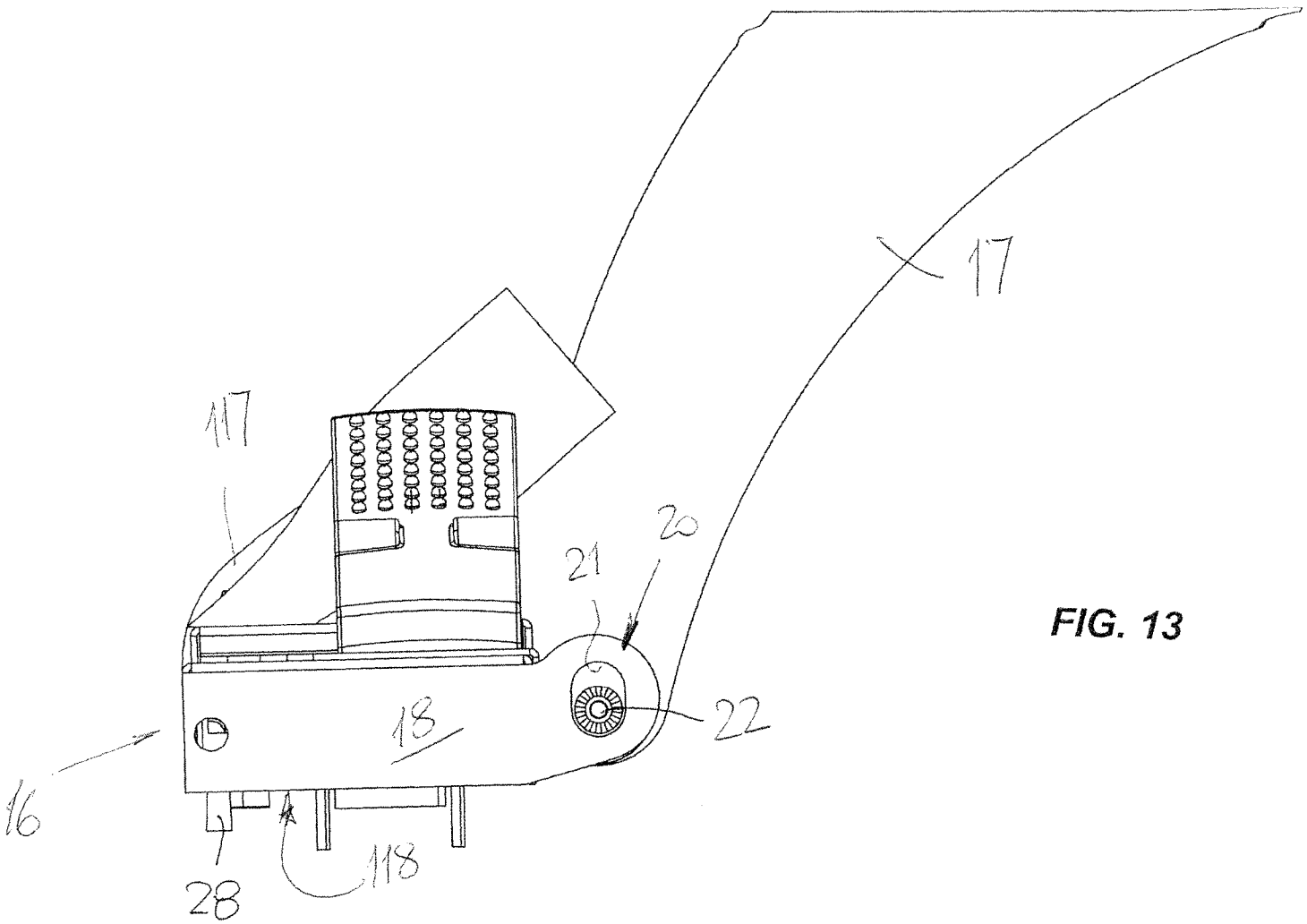
FIG. 13 is a partial and enlarged view of the multifunctional element in a swinging position, slightly raised from the ground.
Figure 14:
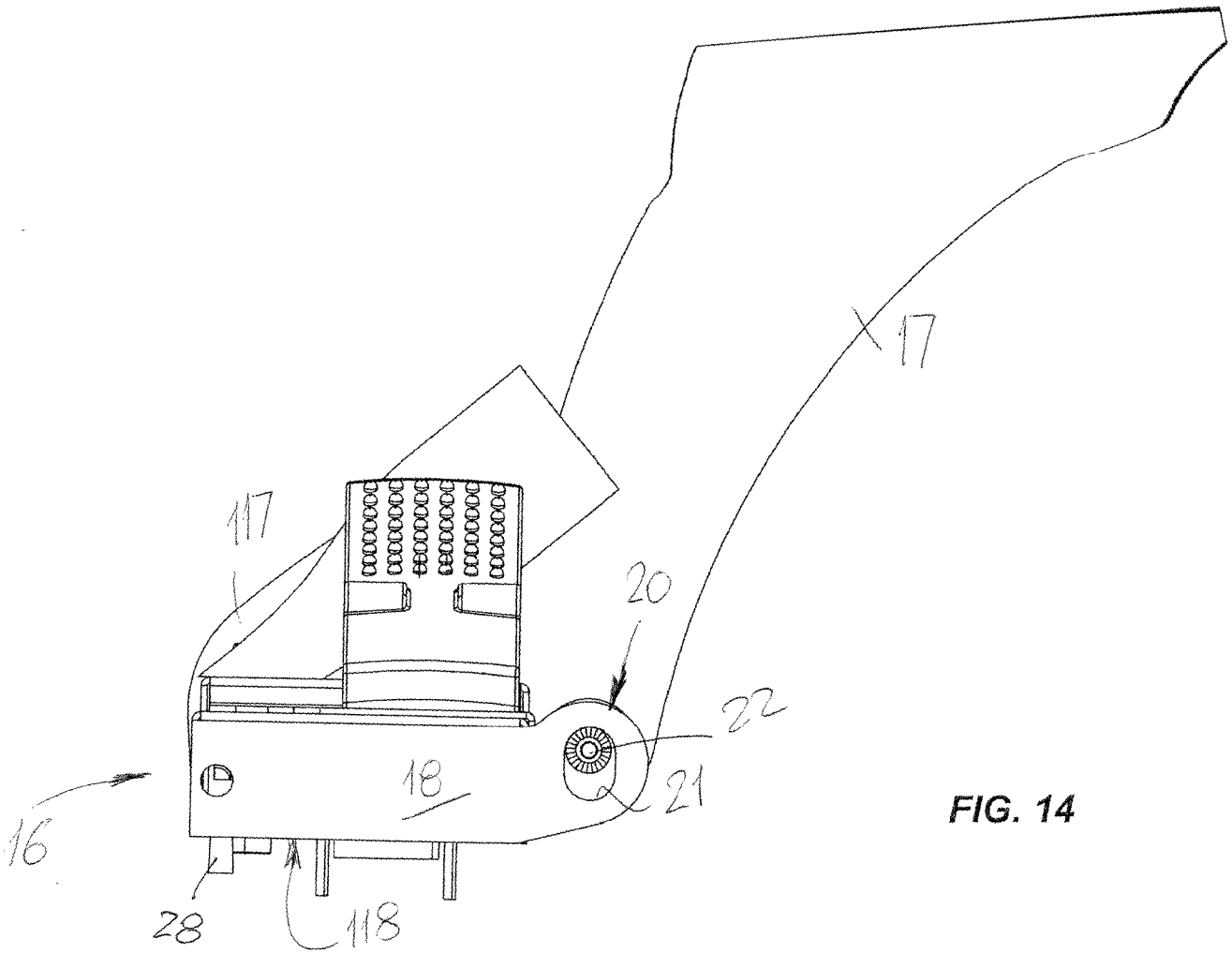
FIG. 14 is a partial view of the multifunctional element of FIG. 13 in a swinging position, fully lowered to the ground.

These adjustment means 20 comprise, for each side of the box-like body 18 (FIGS. 13 and 14) an aperture 21 formed in a proximal area thereof with a transversely and overhangingly extending peg 22 engaged therein, integral with the ends 117.

Figure 15:
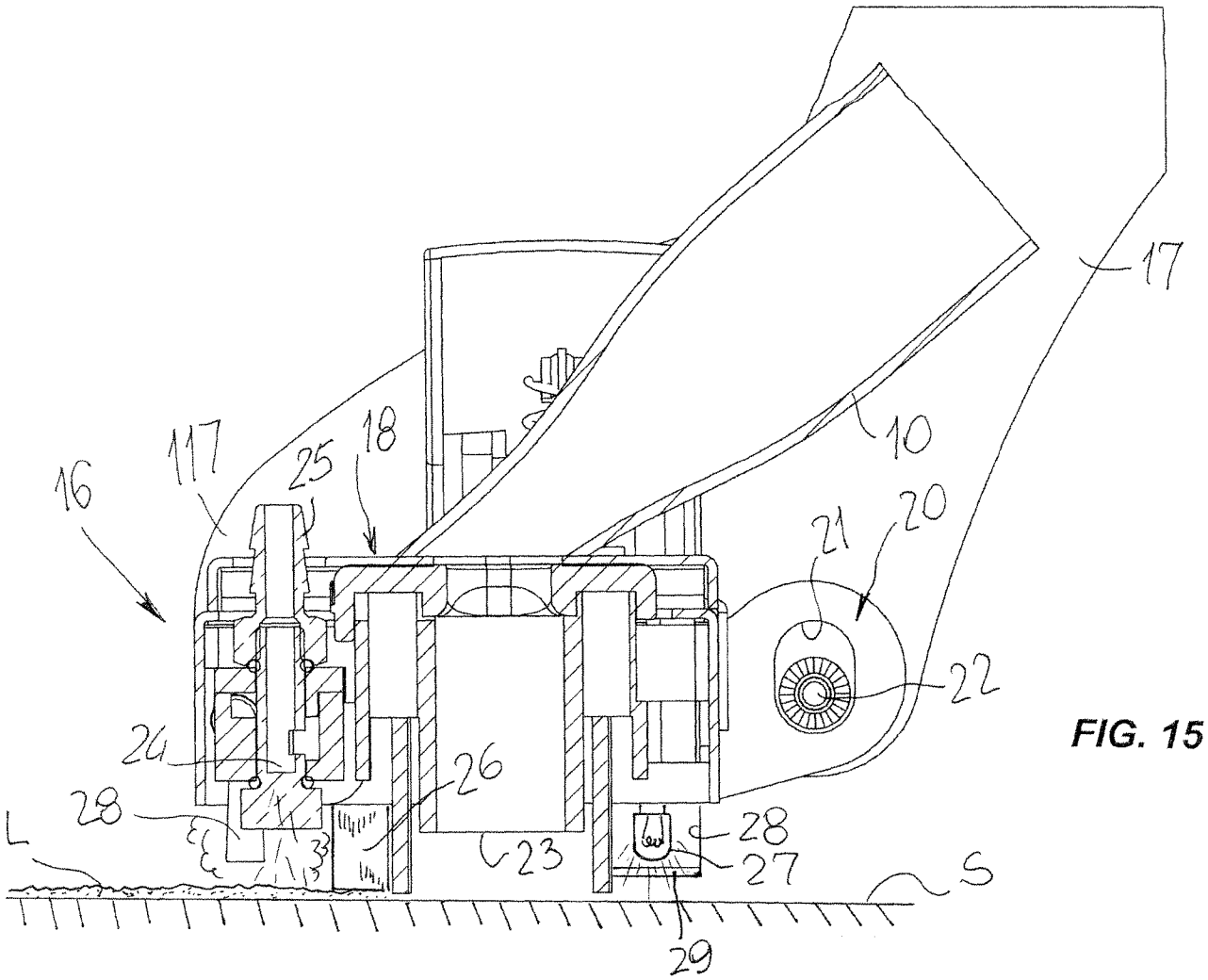
FIG. 15 is a highly schematic, longitudinal sectional view of the multifunctional element.

Still referring to FIG. 1 and to FIGS. 15, 16, 17, it shall be noted that the second pipe 10 reaches a median area of the box-like body 18 in which suction takes place through a suction port 23 formed in the box-like body 18, namely in the bottom face 118 thereof.

The steam carrying conduit 110 also reaches such median area in which a special mount 25 is provided for connection to a plurality of ejecting nozzles 24, also mounted to the bottom face 118 and facing the surface "S" of the ground.

The box-like element 18 optionally accommodates a set of ultrasonic transducers 26 on its bottom face 118, which are arranged between the nozzles 24 and the suction port 23.

Also, the bottom face 118 may have UV lamps 27 arranged thereat in a compartment 28 formed within the box-like element 18, and protected by a high-purity glass 29, to prevent undesired filtering of bactericidal radiation emitted from the lamps 27.

The distal or front area of the bottom face of the box-like element 18 has a line of bristles 28 therein, which form a transverse brush for collection of dust and residues from the surface "S".

Referring now to FIGS. 1, 10, 11, 12, it shall be noted that the pair of arms 17 are equipped with respective stop devices 20 for stopping rotation toward the surface "S", that may adjusted in position.

Typically, each of these stop devices 30 comprises a L-bracket 31, having one leg 32 secured to the corresponding inner surface of the arm 17 and one leg 33 extending at right angles to the leg 32 toward the corresponding opposed leg 33.

A threaded hole 34 is formed in the leg 33 (see FIG. 12) for the shank 35 of a knob 36 to be tightened therein against a helical spring 37 that coaxially encircles the shank 35 and abuts the leg 33.

The shank 35 is of such a length as to extend through and beyond the leg 33 and to abut a stop surface 38 formed in a lateral element 39 which is located on one side of the machine body 2 and provides, with its homologue on the opposite side of the machine body 2, the hinge point for the two arms 17.

As shown in the figures, the two arms 17 are hinged to the machine body 2 by means of two hinges 40 having horizontal and coincident axes, with their respective proximal ends 217 that face away from the ends 117 forming each a flat bracket with two holes 41 and 42 formed therein.

The hole 41 is designed for engagement of a sphere 43 (see FIG. 11) which is outwardly biased by a spring 44 held within a seat 45 formed in each lateral element 39, whereas the hole 42 receives a magnetic element 46, which is designed for alignment with a corresponding magnetic detector element 47, also held within a seat 48 formed in each lateral element 39, only when the two arms 17 are in the working position, i.e. fully lowered to the ground "S".

The coupling arrangement between the magnetic elements 46 and the corresponding magnetic detector elements 47 forms a safety device that only allows operation of the apparatus 1 when the two arms 17 are lowered to the surface "S", with the face 118 of the box-like body 18 lightly touching such surface, and stops its operation when the two arms 17 are in a raised idle position, and the magnetic elements 46 are no longer detected by the magnetic detectors 47.

Referring now to FIGS. 2 to 7, the conformation of the above mentioned valve body 11 is shown in detail.

In detail, the valve body 11 is shown to form a horizontal conduit 111 and a conduit 112 perpendicular to the conduit 111.

At the junction between the two horizontal 111 and perpendicular 112 conduits a selector 12 is inserted in the valve body 11, and is rotated through a handle 212 from the outside to two positions.

Figure 3:
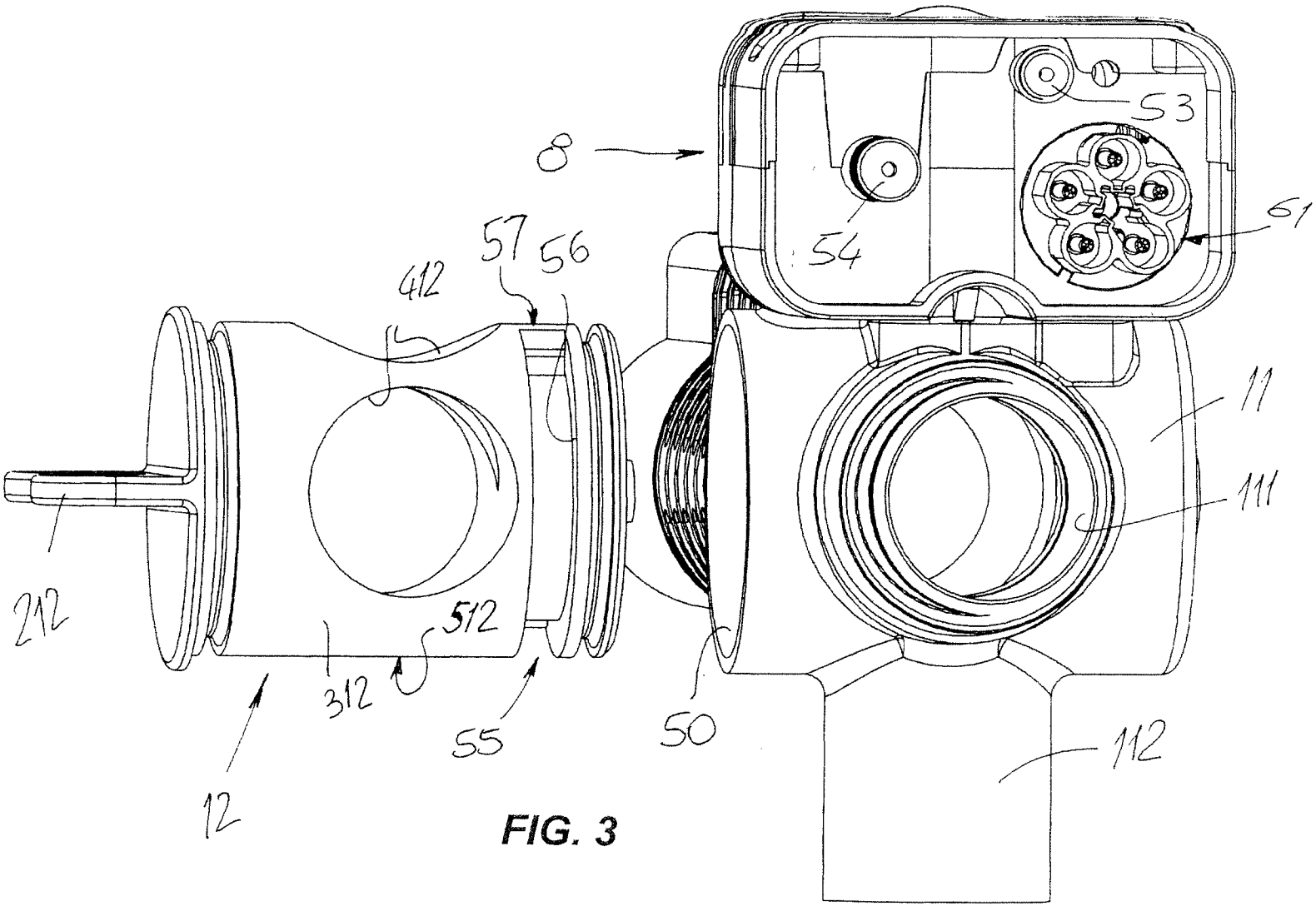
FIG. 3 is an exploded view of the valve element of FIG. 2.
Figure 5:
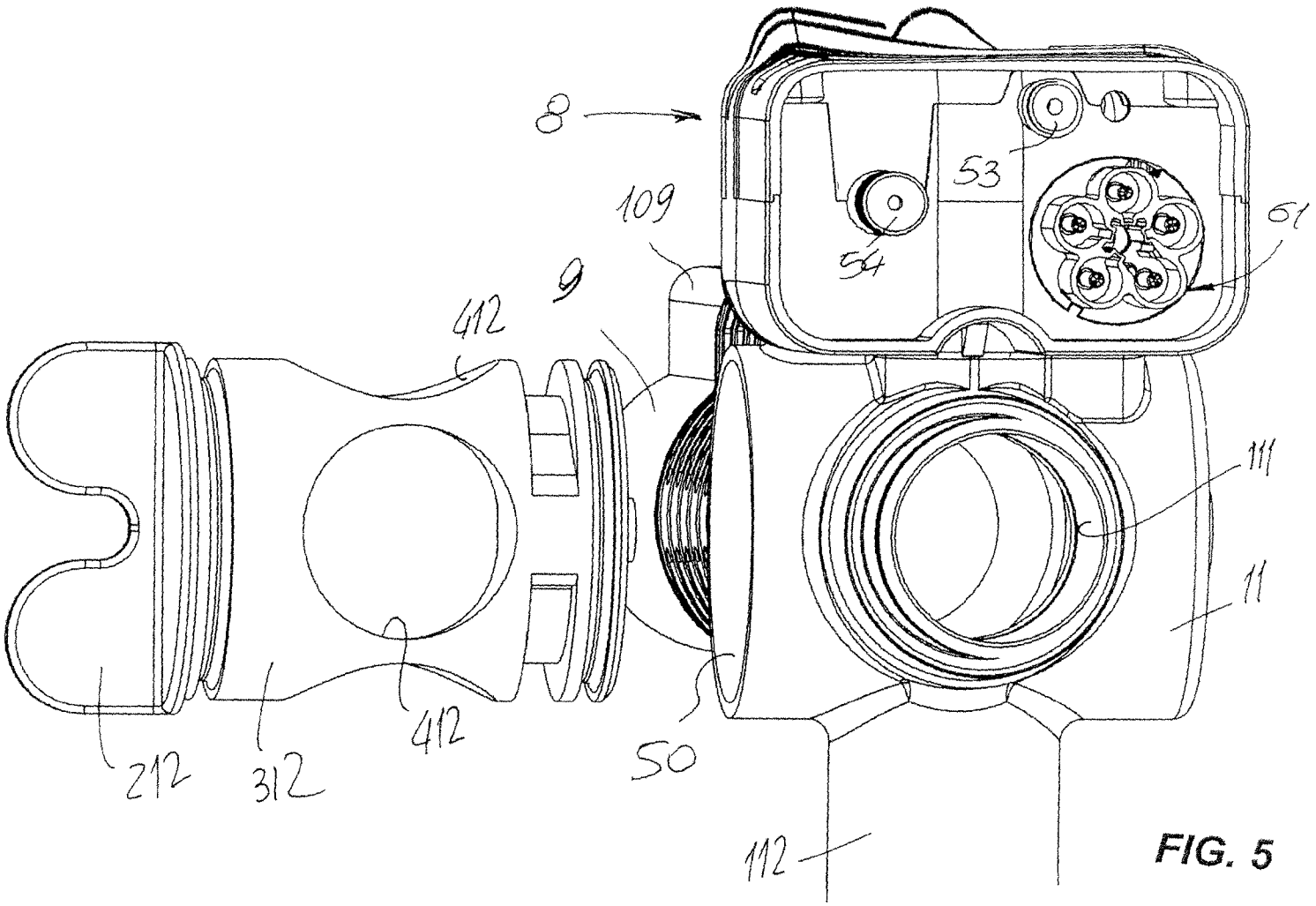
FIG. 5 is an exploded view of the valve element of FIG. 4.
Figure 6:
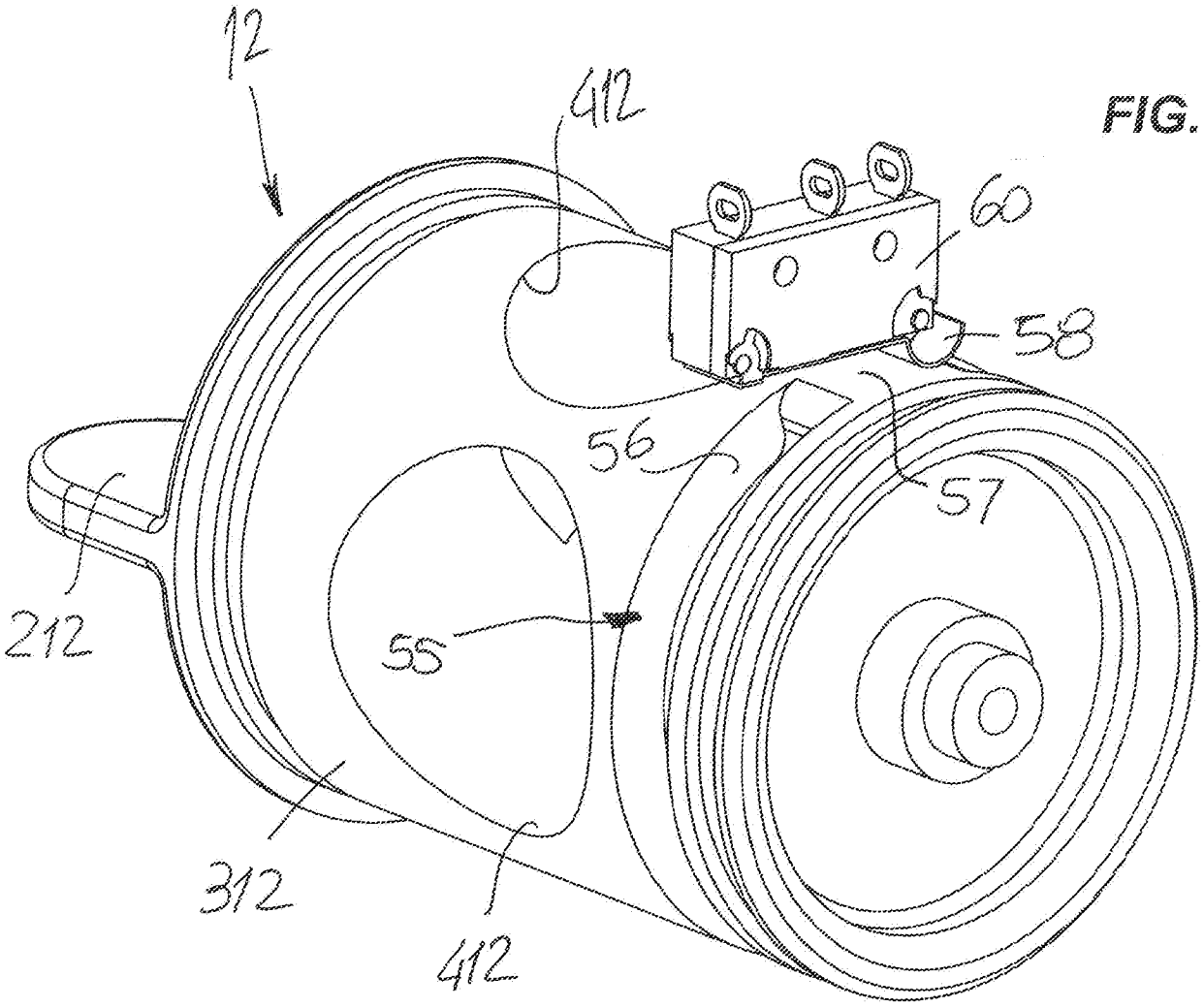
FIG. 6 is a rear detail view of the selector of the valve element of FIG. 2 in the same selected direction.
Figure 7:
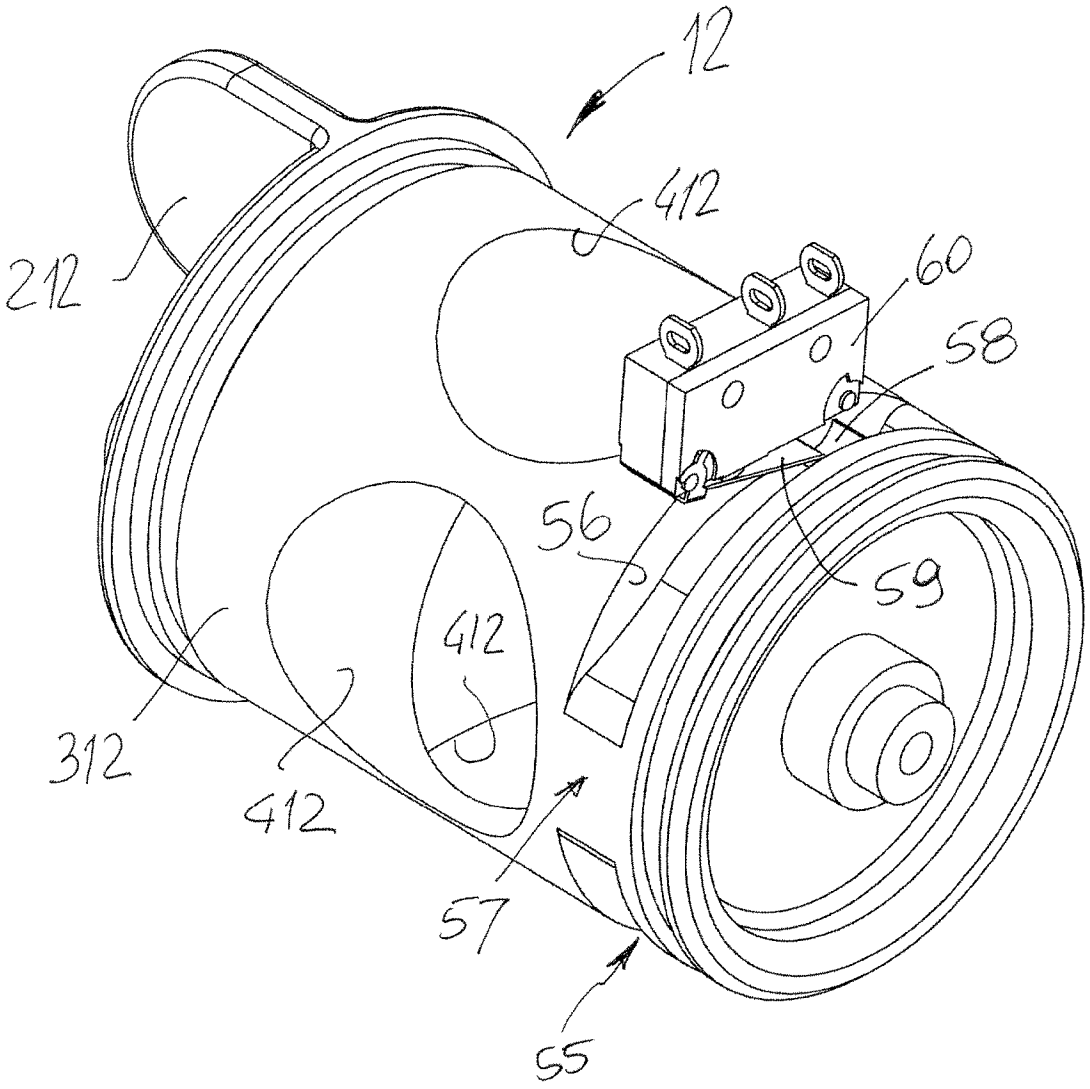
FIG. 7 is a rear detail view of the selector of the valve element of FIG. 4 in the same selected direction.

As shown in FIGS. 3 and 5, the selector 12 has a substantially cylindrical body 312, which is tightly and sealingly held within a hollow seat 50 formed in the valve body 11, to be able to rotate between two alternately selectable end positions.

The cylindrical body 312 has three passages 412, circumferentially arranged at 90° with respect to each other, extending therethrough, whereas the fourth supposed passage 512 (FIG. 3) of the body 312 is a blind passage.

These passages 412 are designed to be alternately aligned with the horizontal conduit 111 or the perpendicular conduit 112 by rotating the selector 12 to allow them to alternately communicate with the suction unit of the apparatus 1.

Typically, the suction circuit of the apparatus 1 reaches the valve body 11 and as the selector 12 is rotated, the suction operation will be addressed to the first pipe 9 or the second pipe 10 and vice versa.

Figure 8:
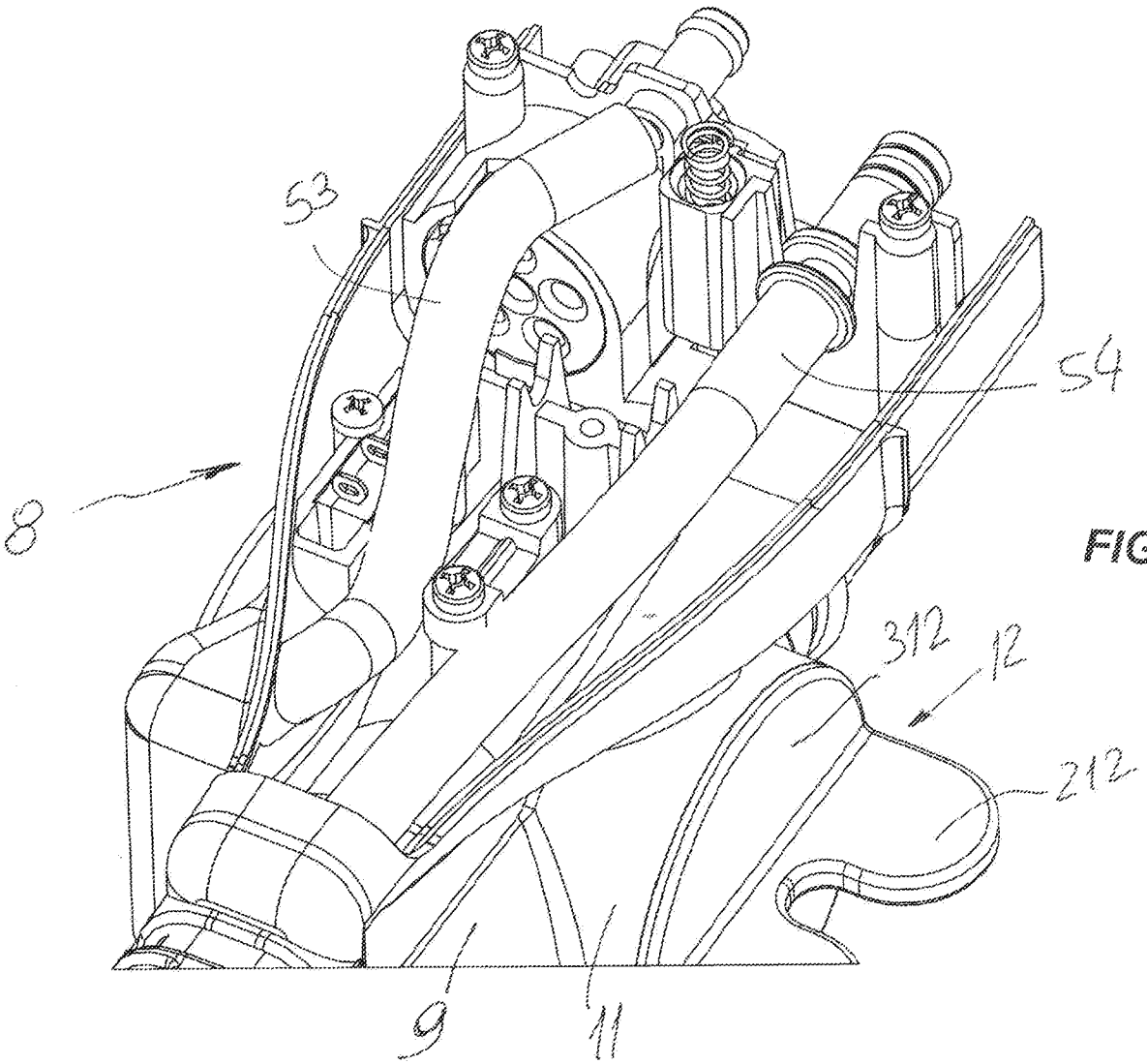
FIG. 8 is a broken-away perspective view of a joint for a pipe, the upper cover being omitted to show the interior thereof.
Figure 9:
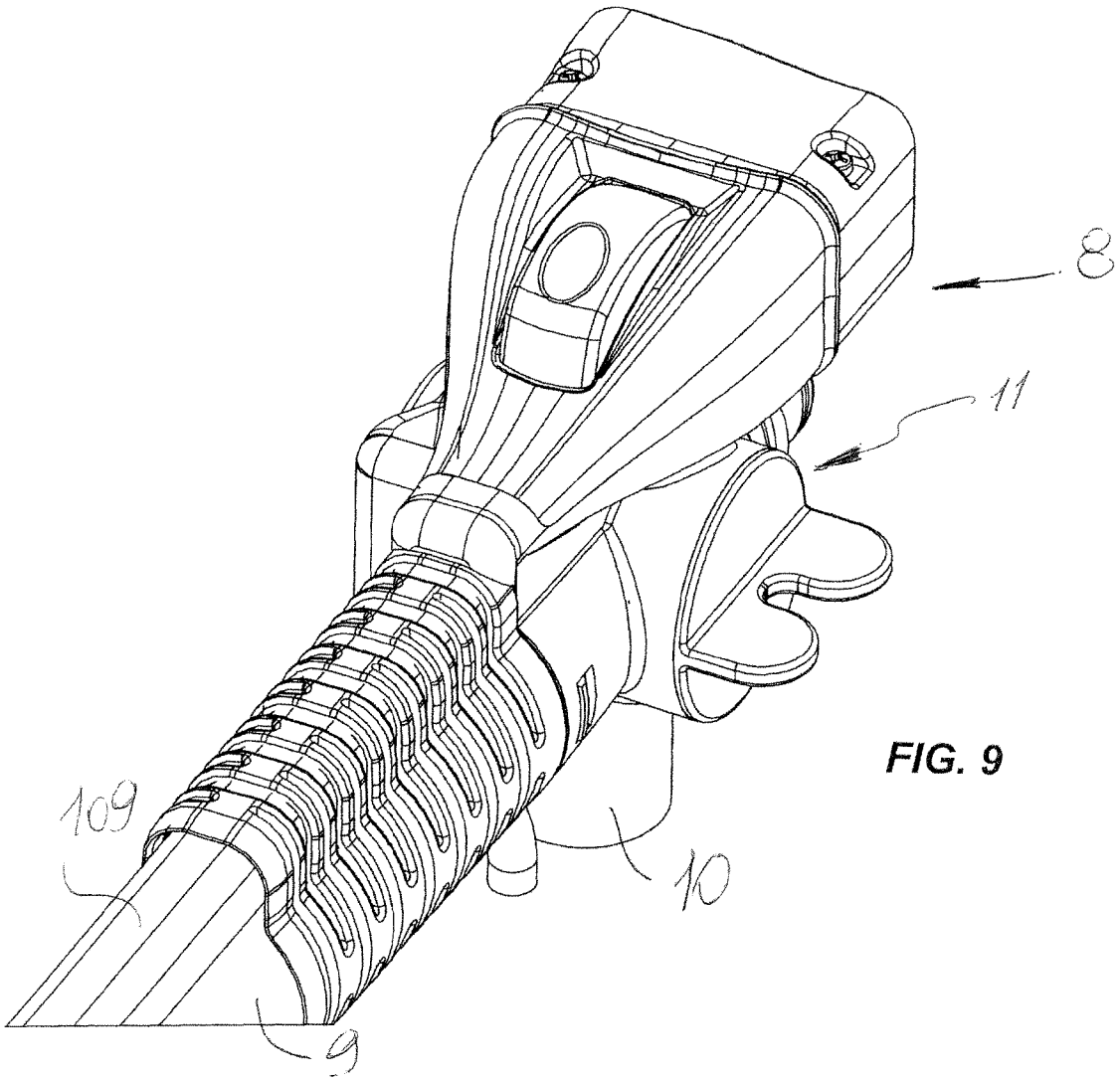
FIG. 9 is a general view of the joint of FIG. 8 and the valve element of FIGS. 2 and 3.

As shown in FIG. 8, the steam carrying pipes also branch into two pipes within the attachment 8, as referenced 53 and 54.

The steam can be also alternately selected to flow into the pipe 53 or into the pipe 54, according to the suction action selected by the selector 12.

In greater detail, the body 312 of the selector 12 is shown to comprise, at the end opposite to the one with the hand grip 212, a cam profile 55 designed as a groove 56 that extends over part of the peripheral surface of the body 312 such that its ends define an ungrooved area, i.e. a kind of ridge 57.

This cam profile 55 is engaged by one end 58 of a contact feeler 59 of a micro-switch 60 which controls selection of steam flow into the pipe 53 or the pipe 54.

Therefore, rotation of the body 312 of the selector 12 between the two possible positions will cause simultaneous selection of either suction through the first pipe 9 and steam flow in the corresponding steam conduit 109 or suction through the second pipe 10 and steam flow in the corresponding steam conduit 110.

As shown in FIGS. 2 to 5, the joint 8 is also equipped with a multipole connector 61 for connection of the electric lines that control operation of the apparatus 1.

In a possible embodiment of the apparatus, the operation of all the devices that compose it is not powered by connecting a typical cable to the mains, but using an electric accumulator, typically an onboard rechargeable battery, e.g. located within the box 15, which will make the apparatus 1 free of any connection to power delivery points in the environments in which it is used.

The operation of the apparatus for cleaning domestic and industrial surfaces "S" will be now described.

Figure 2:
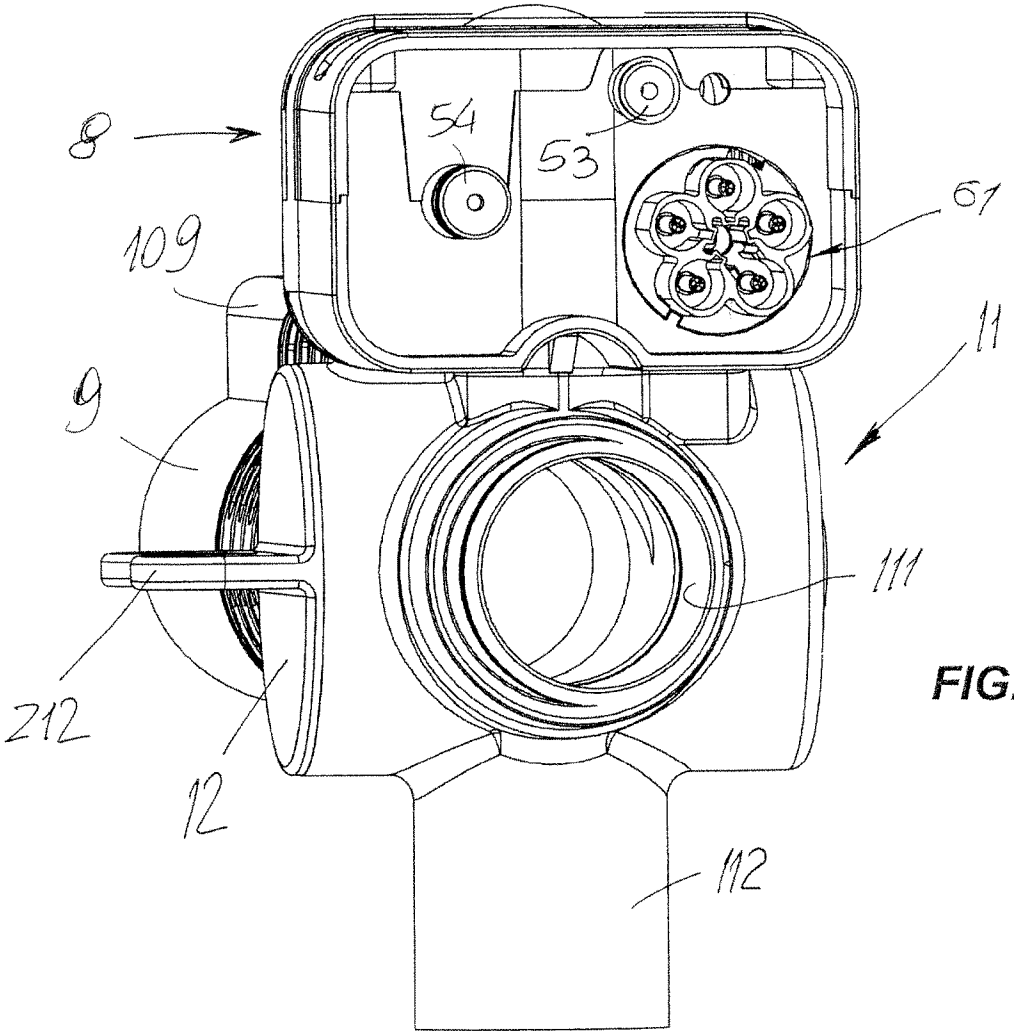
FIG. 2 is an enlarged view of a valve element having a selector in a first position for selecting a first suction and steam carrying direction, combined with a joint for a suction pipe.

When the user chooses to use the apparatus 1 in a conventional manner, i.e. as a normal vacuum cleaner with steam generation, he/she will place the selector 12 in the position as shown in FIGS. 2 and 3, thereby establishing a direct communication between the suction circuit and the first pipe 9 and, through the micro-switch 60, between the corresponding steam carrying conduit 109 and the boiler within the machine body 2.

In this configuration, as mentioned above, the apparatus 1 operates by sucking up debris through the first pipe 9 conveying it into the tank 13.

When needed, the user may operate the steam generation control, for steam to be ejected in jet form through the conduit 109.

In this state, the multifunctional unit 16 is maintained idle, and the two arms 17 are raised from the surface "S".

Figure 4:
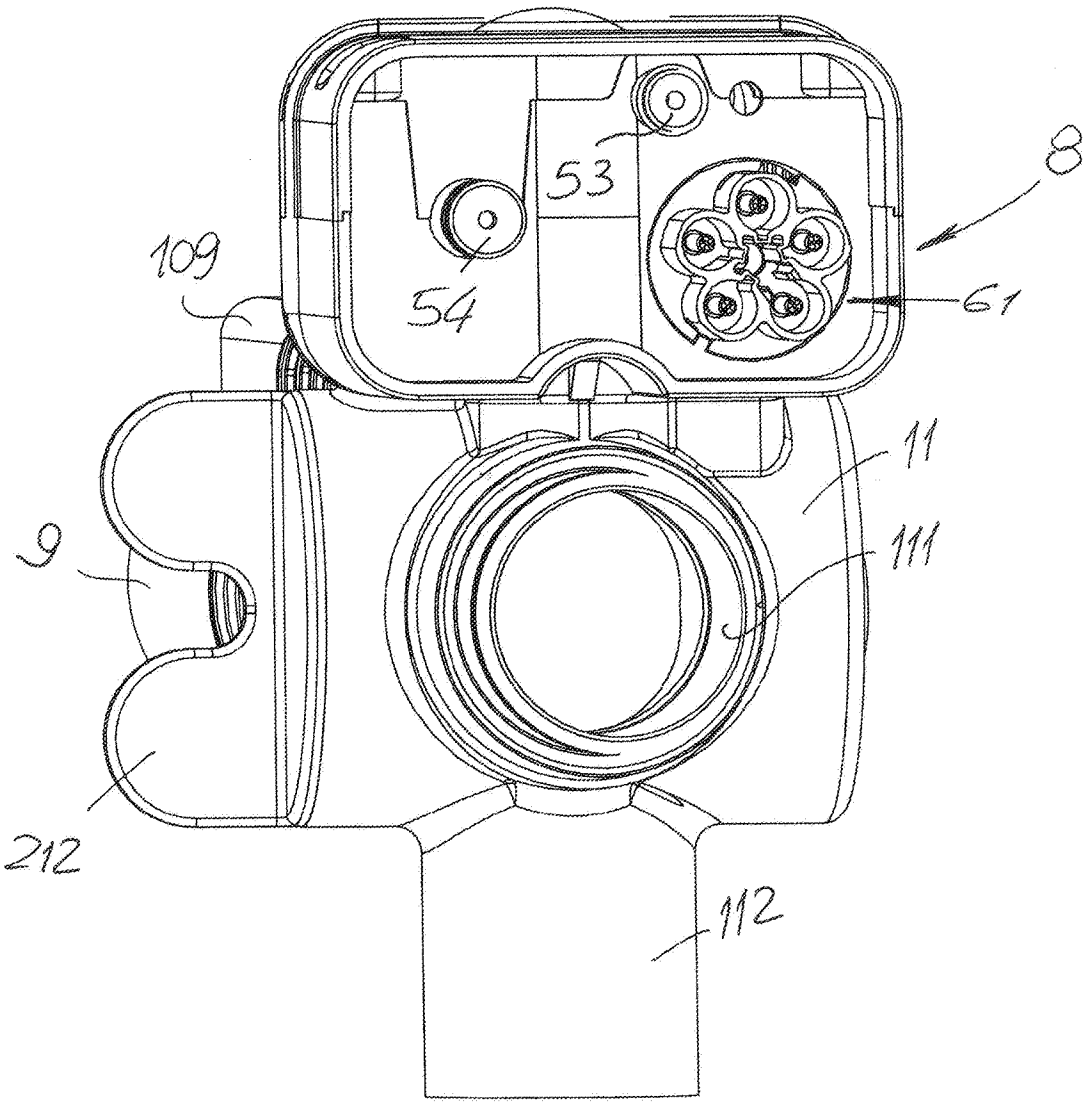
FIG. 4 is a view of the valve element of FIG. 2 with the selector rotated to a second position for selecting a second suction and steam carrying direction, combined with a joint for a suction pipe.

Otherwise, when the user chooses to operate the apparatus 1 by actuating the multifunctional unit 16 and excluding the first pipe 9 and the corresponding steam carrying conduit 109 from operation, he/she will rotate the selector 12 to the position as shown in FIGS. 4 and 5, thereby connecting together the second pipe 10 and the suction unit of the apparatus, located within the machine body 2.

At the same time, as the selector 12 is rotated, the end 58 of the feeler 59 also changes its position, by engaging in the groove 56 and switching electric connections in the micro-switch 60, to stop steam from flowing into the pipe 54 connected with the conduit 104 and to open the passage to the conduit 110 through which steam reaches the box-like body 14 and is ejected outwardly therefrom through ejector nozzles 24.

In this configuration, both arms 17 are rotated toward the surface "S" to move the bottom face 118 of the box-like element 18 as close as possible to it, with such element swinging about the hinges 19 to follow the profile of the surface "S", to the extent this is allowed by the adjustment means 20 which control abutment against the surfaces 38, by tightening or loosening the knobs 36.

When the multifunctional unit 16 is actuated, the apparatus is found to be able to clean to a much greater width as compared with a typical brush attachment of a vacuum cleaner, even a large vacuum cleaner.

Therefore, the apparatus 1, whose operation may be also optionally powered by a rechargeable battery unit, will be able to clean very large surfaces without requiring the user to systematically hold and maneuver the first pipe 9, the user being simply required to easily push the machine body 2 in every direction.

More in detail, in order to extend the battery-powered operation time, the apparatus 1 may be connected before use to a normal power-distribution network, to support the greater power requirements for heating the boiler to the evaporation temperature of water contained therein using the mains power and then, during operation, battery power may be only used to keep the evaporation temperature substantially constant.

When the user has to reach hardly accessible locations, he/she may switch the selector 12 again to temporarily disable the multifunctional unit 16 and functionally re-enable the pipe 9 and its respective steam carrying conduit 109, thereby restoring the apparatus 1 to its conventional vacuum cleaner operation.

It should be noted that, if needed, the box-like element 18 may be equipped with ultrasonic transducers 26 which will respond to contact with a layer of liquid "L" (see FIG. 15) created on the surface "S" by steam jets from ejector nozzles 24, by emitting ultrasounds that will spread throughout the layer of liquid "L" and disrupt dirt event in encrusted form.

Furthermore, the box-like element 18 may be also equipped with UV lamps 27, with the purpose of decontaminating the surface "S" from any bacterial form.

The multifunctional element 16 may have special clips 66 on the top face opposite to the bottom face 118, for removably fastening and holding cleaning cloths and rags.

The invention has been found to fulfill the intended objects.

The invention so conceived is susceptible to changes and variants within the inventive concept.

Also, all the details may be replaced by other technical equivalent elements.

In its practical implementation, any material, shape and size may be used as needed, without departure from the scope as defined by the following claims.

The invention claimed is:

1. An apparatus for cleaning domestic and industrial surfaces, comprising:

a box-shaped machine-body (2), wherein a sucking system and a steam generating system are housed, the machine-body defining a front portion (202) and an opposing rear portion (102); and a joint (8) arranged on the machine-body (2) configured to be coupled to an end of a first flexible duct (9, 109) designed to suck and to convey steam;

wherein said machine-body (2) comprises an additional multi-function group (16) for sucking and ejecting steam, which is overhangingly supported by said machine-body (2) by a support structure (17) movably associated with said machine-body (2), and wherein said support structure comprise two bilateral arms (17) which are overhangingly turned over said front portion (202).

2. The apparatus as claimed in claim 1, wherein, between said first flexible duct (9, 109) and said additional multi-function group (16), a selector (11, 12) is interposed designed to alternatively select an actuation of said first flexible duct (9, 109) or of said additional multi-function group (16).

3. The apparatus as claimed in claim 1, wherein said arms are movable between a lowered active position toward a surface (S) and an inactive position raised from said surface (S).

4. The apparatus as claimed in claim 3, further comprising an adjusting device (30) that adjusts a position of said arms (17) in at least said active position, said adjusting device being interposed between said bilateral arms (17) and said machine-body (2).

5. The apparatus as claimed in claim 3, further comprising a blocking system (46, 47) that blocks operation of said apparatus (1), said blocking system being configured to be activated at least in said inactive position of said bilateral arms (17) and being interposed between said bilateral arms (17) and said machine-body (2).

6. The apparatus as claimed in claim 1, wherein said additional multi-function group (16) comprises a brush (18) which is transversally supported between corresponding ends (117) of said bilateral arms (17) and defining a face (118), which is turned toward the surface (S) and which comprises a steam ejector (24) and at least one sucking opening (23).

7. The apparatus as claimed in claim 6, wherein said brush (18) is swinging supported between said ends (117) of said bilateral arms (17) by a swing control system (20).

8. The apparatus as claimed in claim 1, wherein said additional multi-function group (16) comprises an ultrasound emitter (26) toward said surface (S).

9. The apparatus as claimed in claim 1, wherein said additional multi-function group (16) comprises an ultraviolet light emitter (27) designed for a bacteriological decontamination of said surface (S).

10. The apparatus as claimed in claim 1, wherein said sucking system and steam generating system are fed by a storage battery.

* * * * *